US005269109A

United States Patent [19]

Gulur

[11] Patent Number: 5,269,109

[45] Date of Patent: Dec. 14, 1993

[54] INSULATED LOAD BEARING WALL AND ROOF SYSTEM

[76] Inventor: V. Rao Gulur, 2012 Lincoln Cir., Renton, Wash. 98055

[21] Appl. No.: 32,150

[22] Filed: Mar. 17, 1993

Related U.S. Application Data

[62] Division of Ser. No. 854,090, Mar. 19, 1992.

[51] Int. Cl.[5] ..... E04C 2/26; E04B 7/00

[52] U.S. Cl. ..... 52/309.9; 52/90.1; 52/309.7; 52/404; 52/593

[58] Field of Search ..... 52/90.1, 309.7, 593, 52/404, 309.4, 309.12, 210, 262, 92.1, 809, 593, 309.9

[56] References Cited

U.S. PATENT DOCUMENTS

| | | | |
|---|---|---|---|
| 4,259,028 | 3/1981 | Cook | 52/309.9 |
| 4,578,909 | 4/1986 | Henley et al. | 52/90.1 |
| 4,628,650 | 12/1986 | Parker | 52/265 |
| 4,641,468 | 2/1987 | Slater | 52/309.9 |
| 4,671,032 | 6/1987 | Reynolds | 52/210 |
| 4,674,253 | 6/1987 | Young | 52/404 |

*Primary Examiner*—Carl D. Friedman
*Assistant Examiner*—Chrisophter Todd Kent
*Attorney, Agent, or Firm*—Delbert J. Barnard

[57] ABSTRACT

An insulated load bearing wall (10, 10') comprising panels of extruded polymer foam (20, 22, 50, 52, 54, 56) into which tubular, load carrying frame members (12, 14, 48) have been incorporated. A tongue is formed at one vertical edge of each panel (10, 10') and a groove is formed at the opposite vertical edge. The tubular frame members (12, 14, 48) are bonded to the extruded polymer foam.

3 Claims, 3 Drawing Sheets

INSULATED LOAD BEARING WALL AND ROOF SYSTEM

This application is a continuation of application Ser. No. 07/854,090, filed Mar. 19, 1992.

DESCRIPTION

1. Technical Field

This invention relates to insulated walls for buildings. More particularly, it relates to the provision of an insulated wall and roof system which is constructed from panels which each comprise a main body of polymer foam and tubular frame members.

2. Background Art

It is known to construct wall panels for buildings from expanded polystyrene and metal frame members. ALSCO Building Products, a unit of ARCO Chemical Company, which is a division of the Atlantic Richfield Company, markets a wall system of this type under the trademark WALLFRAME TM. A second wall system of this type is marketed by NU-TECH Building Systems, of Cleveland Ohio, under the trademark CANO-THERMO TM.

A principal object of the present invention is to provide an insulated wall constructed from extruded (rather than expanded) polymer foam and tubular metal frame members, which wall is structurally superior to such known wall constructions, and which includes an improved joint construction by which adjacent wall panels are connected to each other.

DISCLOSURE OF THE INVENTION

A first embodiment of the invention comprises a plurality of tubular load carrying members. Steel angle frame members extend along the upper and lower inside and outside edges of the wall. Extruded polymer foam fills the space between the tubular frame members in both the thickness and width dimensions of the wall.

In preferred form, the wall comprises core sections of the extruded polymer foam which have a thickness dimension equal to the distance between the tubular frame members in the width dimension of the wall, and inside and outside sheets of the extruded polymer foam. The sheets outwardly bound the core material and extend between the tubular frame members in the width dimension of the wall.

A second embodiment of the invention comprises a plurality of tubular metal load carrying frame members. Metal angle members extend along the upper and lower inside and outside corners of the wall. Extruded polymer foam outwardly bounds the metal load carrying members and extends between the metal load carrying members widthwise of the wall, to form a wall which is essentially all extruded polymer foam and metal frame members.

In preferred form, this wall may comprise core sections of the extruded polymer foam which have a thickness dimension substantially equal to the thickness dimension of the tubular metal frame members, and inside and outside sheets of the extruded polymer foam. The core material extends between the inside and outside tubular metal frame members in the width direction of the wall. The sheets of extruded polymer foam outwardly bound the core sections and the tubular metal frame members.

In each embodiment, the wall is preferably constructed in panels and the extruded polymer foam is shaped to provide a tongue along one vertical edge of the panel and a complimentary groove along the other vertical edge of the panel. In an embodiment comprising core sections and side sheets above the extruded polymer foam, a core section may be made to project outwardly beyond the side sheets to form the tongue. At the opposite edge, the side sheets may be formed to extend outwardly beyond the core, to form the groove.

BRIEF DESCRIPTION OF THE DRAWING

Like reference numerals are used to designate like parts throughout the several views of the drawing, and.

BEST MODE FOR CARRYING OUT THE INVENTION

Figure 1:
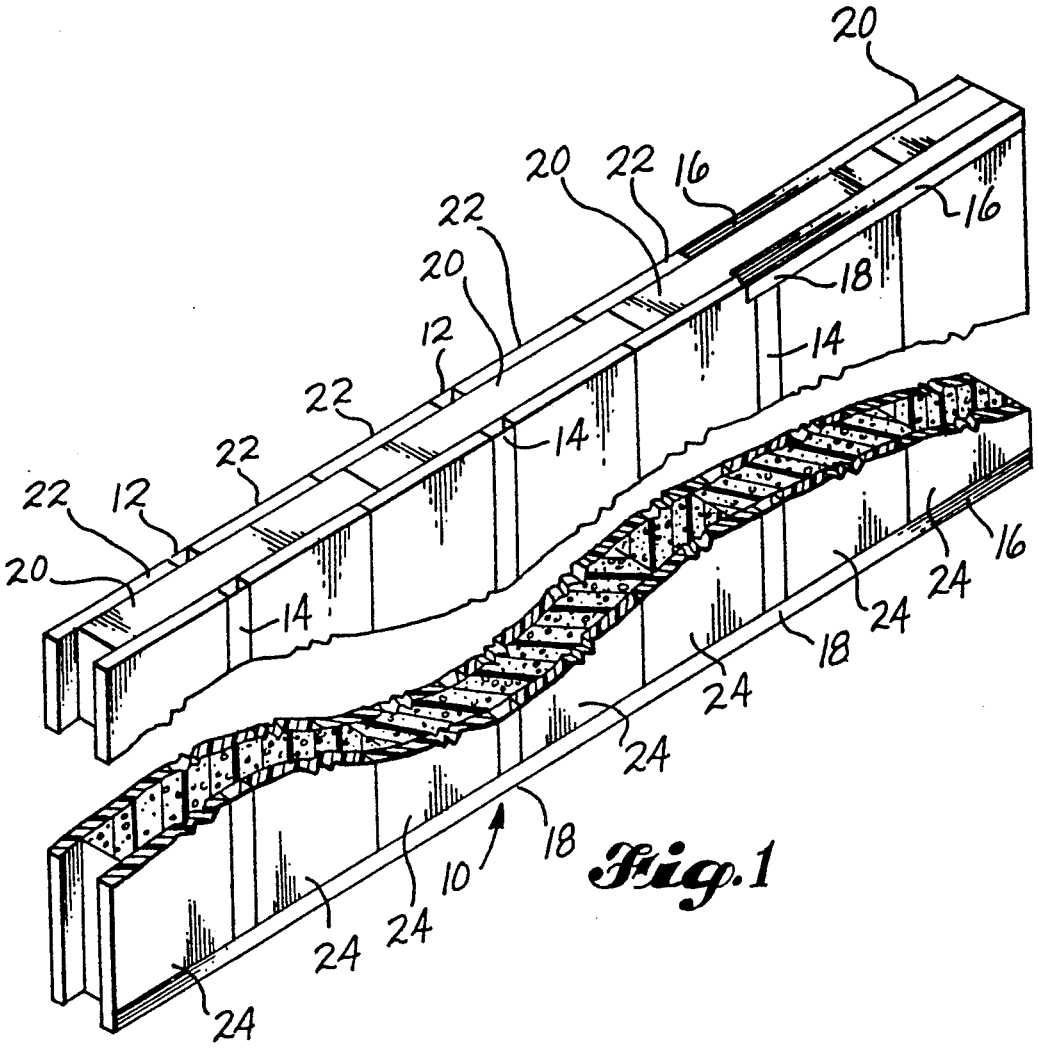
FIG. 1 is a fragmentary pictorial view of an insulated load bearing wall, constructed in accordance with the present invention, with center portions of the wall cut away for the purpose of shortening the height of the wall.
Figure 2:
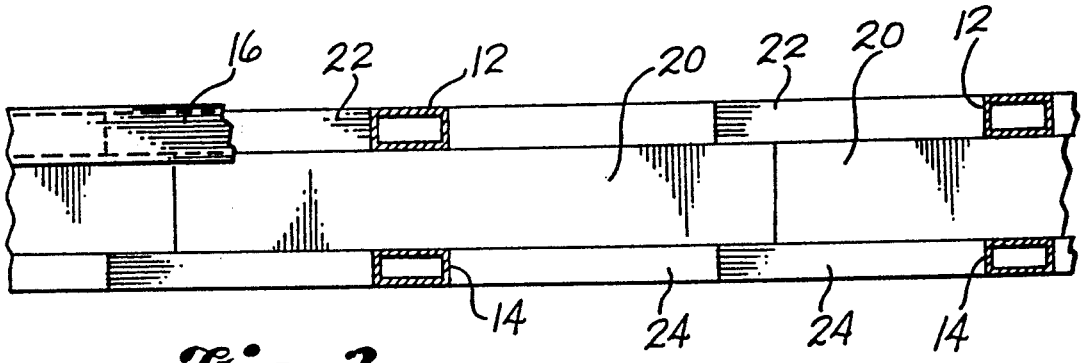
FIG. 2 is a fragmentary top plan view of the wall shown by FIG. 1.

Referring to FIGS. 1 and 2, the wall 10 is shown to comprise a plurality of vertically extending frame members 12, 14. The frame members 12, 14 are lengths of tubular steel or other suitable tubular metal. Frame members 12 are horizontally spaced apart from each other on the outside of the wall 10. In like fashion, the frame members 14 are horizontally spaced apart from each other on the inside of the wall. In preferred form, the outside frame members 12 and the inside frame members 14 are positioned opposite each other in the thickness dimension of the wall 10.

In preferred form, metal angle members 16 extend along the upper and lower edges of the wall 10. The vertical legs of these angle members may be fastened to the tubular frame members 12, 14, such as by the use of screw fasteners 18.

Extruded polymer foam extends between the metal frame members in both the thickness and width directions of the wall. This results in the wall 10 being essentially extruded polymer foam and metal frame members.

In the embodiment illustrated by FIGS. 1 and 2, the extruded polystyrene material comprises a plurality of core sections 20 and a plurality of side sheets 22, 24. The core sections 20 have a thickness substantially equal to the distance between the frame members 12, 14 in the thickness dimension of the wall 10. The side sheets 22, 24 each have a thickness substantially equal to the thickness of the metal frame members 12, 14.

In the embodiment shown by FIGS. 1 and 2, the core sections 20 may be made to extend outwardly beyond the side sheets 22, 24 at one vertical edge of the panel. The side sheets 22, 24 are then formed to extend outwardly beyond the puller section at the opposite vertical edge of the panel. This forms a tongue and groove joint by which adjacent panels may be secured together.

It is also possible to make the extruded polymer foam of each panel a single unitary member, rather than form a core section 20 and side sheets 22, 24 glued together.

The wall may be erected in the following manner. Firstly, the lower metal angle member 16 may be secured in a suitable fashion to a foundation structure. Then, the panels may be assembled together with their lower ends located in the space defined between the upwardly extending legs of the lower angle member 16. Then, the upper angle members 16 may be put in place. As previously stated, screw fasteners 18 or the like may be used for securing the angle member 16 to the frame members 14.

Figure 3:
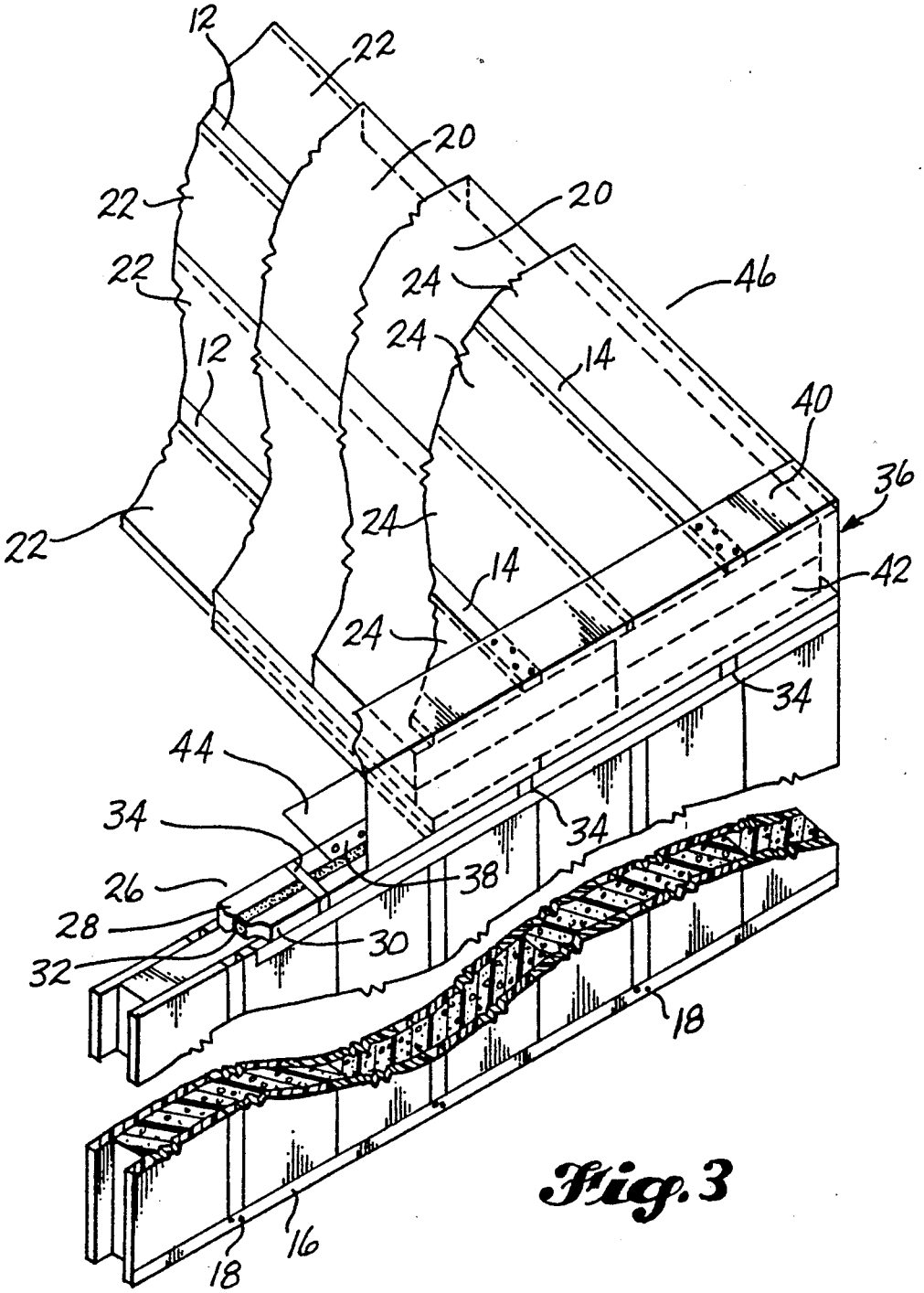
FIG. 3 is a fragmentary pictorial view of a portion of an insulated load bearing wall of the type shown by FIGS. 1 and 2, together with a portion of an insulated roof which along one edge sets down on and is supported by the load bearing wall.

Referring to FIG. 3, this figure shows a wall construction of the type shown by FIG. 2, onto which an insulated plate member 26 has been installed. Plate member 26 comprises a pair of elongated wood members 28, 30 and an elongated extruded polymer foam bar 32 sandwiched between the wood members 28, 30. The wood members are bonded to the extruded polymer foam 32, by a suitable adhesive. Also, reinforcing bands 34 may be placed on the insulated plate member 26 at locations spaced apart along the length of the plate member 26. The bands 34 may be constructed from a structural reinforced plastic or composite materials. By way of example, they may be constructed from any one or a combination of graphite, Kevlar (trademark), and fiberglass for reinforcement, and epoxy as a bonding agent. Phenolic or other resins may be used in place of epoxy as the bonding agent.

Next, a rafter seat 36 may be connected to the plate 26. It is formed from sheet metal and comprises a lower wall 38, an upper wall 40, and a vertical outside wall 42. The lower wall 38 may comprise a first section which sets down onto and is secured to the plate 26, and a second section 44 which projects laterally from the first section. The second section 44 and the top member 40 extend at a slope equal to the roof slope. A composite roof 46 is shown. It may be constructed like the walls 10 except with two or more rather than one thickness of the core material.

Figure 4:
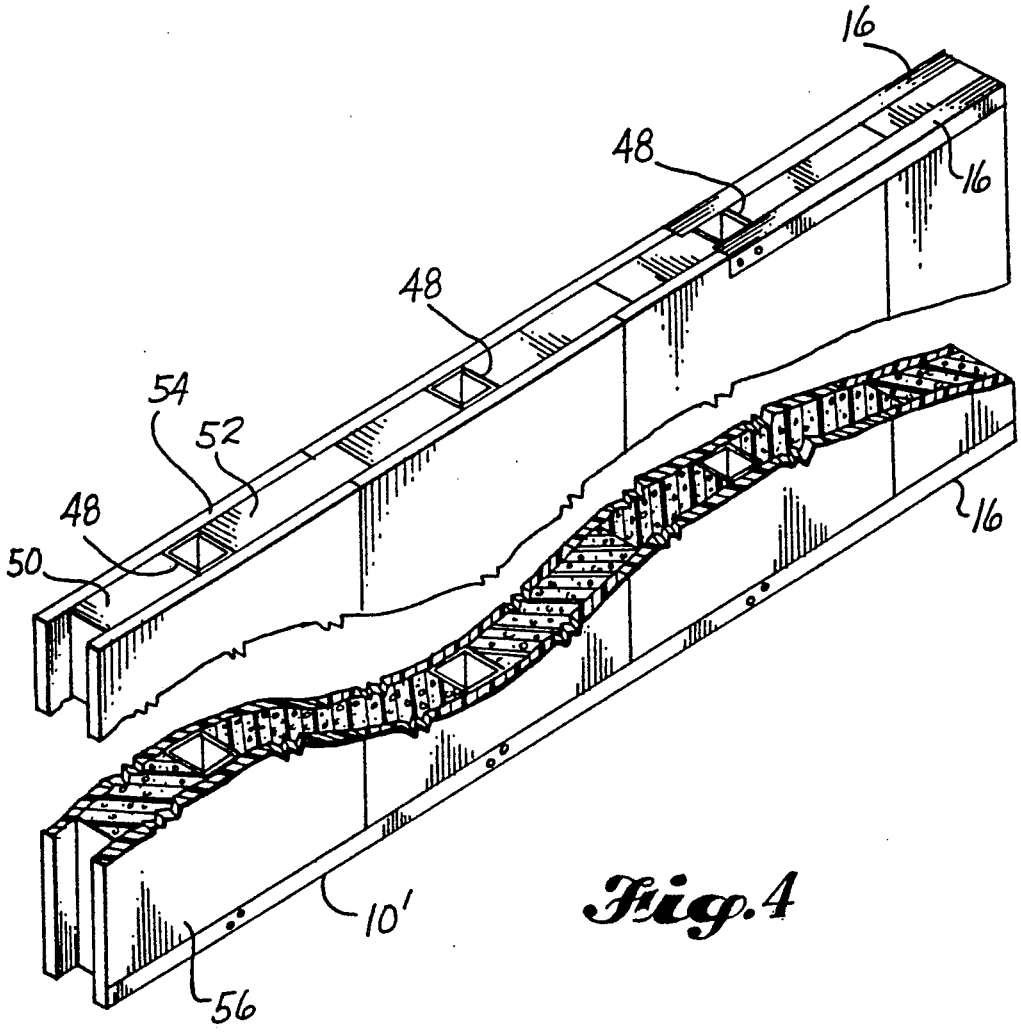
FIG. 4 is a view like FIG. 1, but of a second embodiment of the wall.

Referring now to FIG. 4, the second embodiment of the wall comprises tubular frame members 48 extruded polymer foam core sections 50, 52 and extruded polymer foam side sheets 54, 56. In this embodiment, the tubular frame members 48 are incorporated into the core of the wall 10'. The core members 50, 52 are substantially equal in thickness to the members 48 in the thickness dimension of the wall 10'. The core material 50, 52 is located between the metal frame members 48, througout the width dimensions of the wall 10'. The metal frame members 48 are shown to be substantially centered in the width dimension of each panel. Core section 50 is shown to be narrower than core section 52. The dimensioning of these core panels 50, 52 is such that core panel 52 projects beyond the vertical edges of the side sheets 54, 56, at one vertical edge of the panel. The side sheets 54, 56 extend outwardly beyond the core section 50 at the opposite vertical edge of the panel. In this manner, tongue and groove joint components are formed.

Wall 10', as in the first embodiment, comprises metal angle members 16 at the upper and lower edges of the wall 10'.

In accordance with the invention, the core sections 50, 52 and the side sheets 54, 56 may constitute a single unitary extrusion.

The arrangement of the frame members (12, 14 in the first embodiment, and frame members 48 in the second embodiment) and the use of extruded polymer foam rather than expanded polymer foam, with the frame members firmly bonded to the foam, results in a wall construction in which the components interact and each is stronger in the combination than it is by itself.

Examples of extruded polymer foams are polystyrene, polyethylene, polyisocynaurite and polyeurothane.

Window and door openings may be bounded by structural metal members and metal sheeting may be used at the corners formed by intersecting walls and by the roof intersecting a wall.

The illustrated embodiments are presented by way of example. The invention is not to be limited by such examples, but rather is defined by the claims.

What is claimed is:

1. An insulated wall section having first and second vertical edges, comprising:

a plurality of tubular metal, outside frame members and a plurality of tubular metal, inside metal frame members, said outside frame members being spaced apart on the outside of the wall and the inside frame members being spaced apart on the inside of the wall;

metal angle frame members extending along the upper and lower corners of the wall section;

a core of extruded polymer foam which has a thickness substantially equal to the distance between the inside and outside tubular frame members, and inside and outside panels of extruded polymer foam, each having a thickness substantially equal to the thickness of the metal frame members.

said core extending between the inside and outside tubular metal frame members in the thickness direction of the wall, said panels of extruded polymer foam extending from the metal frame members in the width direction of the wall, and outwardly bounding the core, said panels and said core being staggered in the width direction of the wall to form a tongue at the first vertical edge of the wall section formed by a projecting portion of the core and a groove at the second vertical edge of the wall section formed by and between projecting portions of said inside and outside panels;

said tubular metal frame members being intermediate in the wall section of the tongue and the groove, and said core and said panels being bonded to each other and to the tubular metal frame members.

2. A wall according to claim 1, further comprising an insulated upper plate member on top of the wall, said insulated upper plate member having a rectangular cross sectional shape and comprising inside and outside elongated wood members and a bar of insulating material sandwiched between and bonded to the wood members, to form a thermal break.

3. An insulated roof section having first and second edges, comprising:

a plurality of tubular metal, outside frame members, and a plurality of tubular metal, inside frame members, said outside frame members bring spaced apart on the outside of the roof and the inside frame members being spaced apart on the inside of the roof section:

a core of extruded polymer foam which has a thickness substantially equal to the distance between the inside and outside tubular frame members;

inside and outside panels of extruded polymer foam, each having a thickness substantially equal to the thickness of the metal frame members, said core extending between the inside and outside metal frame members in the thickness dimension of the roof, and said panels of extruded polymer foam extending from the metal frame members in the width direction of the roof, and outwardly bounding the core material, said panels and said core being staggered in the width direction of the roof section such that a tongue is formed at the first edge and a complementary groove is formed at the second edge, said tongue being formed by a projecting portion of the core and said groove being formed by and between projecting portions of said inside and outside panels;

said tubular metal frame members being intermediate in the roof section of the tongue and the groove, and said core and said panels being bonded to each other and to the tubular metal frame members.

* * * * *